US010694583B2

(12) United States Patent
Sarukawa et al.

(10) Patent No.: US 10,694,583 B2
(45) Date of Patent: Jun. 23, 2020

(54) EXTERNAL HEATER OPERATION DETERMINATION SYSTEM AND VEHICLE CONTROL SYSTEM

(71) Applicant: SUBARU CORPORATION, Tokyo (JP)

(72) Inventors: Tomoo Sarukawa, Tokyo (JP); Masami Yamamoto, Tokyo (JP); Ringo Shimada, Tokyo (JP); Hiroto Asai, Tokyo (JP); Yo Masuda, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 0 days.

(21) Appl. No.: 16/175,116

(22) Filed: Oct. 30, 2018

(65) Prior Publication Data

US 2019/0191489 A1 Jun. 20, 2019

(30) Foreign Application Priority Data

Dec. 20, 2017 (JP) ..... 2017-243338

(51) Int. Cl.
*H05B 1/02* (2006.01)
*F01P 11/16* (2006.01)

(52) U.S. Cl.
CPC ..... *H05B 1/0236* (2013.01); *F01P 11/16* (2013.01)

(58) Field of Classification Search
CPC ..... F01P 5/10; F01P 7/164; F01P 2005/105; F01P 2005/125; F01P 2025/32; F01P 11/16; F02N 19/10; H05B 1/0236
See application file for complete search history.

(56) References Cited

U.S. PATENT DOCUMENTS 6,425,353 B1 * 7/2002 Davies ..... F01P 5/10 123/41.44
8,140,246 B1 * 3/2012 Manchanda ..... F01P 11/16 123/41.15

(Continued)

FOREIGN PATENT DOCUMENTS

JP 2004-346831 A 12/2004
JP 2010-101190 A 5/2010

(Continued)

OTHER PUBLICATIONS

Japanese Notice of Reasons for Refusal issued in corresponding Japanese Patent Application No. 2017-243338, dated Sep. 10, 2019, with English translation.

*Primary Examiner* — Anne Marie Antonucci
*Assistant Examiner* — Andrew J Cromer
(74) *Attorney, Agent, or Firm* — McDermott Will & Emery LLP

(57) ABSTRACT

An external heater operation determination system includes, in a vehicle: a first device to be heated by an attached external heater; a second device, separate from the first device, to be cooled by a refrigerant; a circulation device configured to circulate the refrigerant through a circuit; and a temperature detection device that is configured to detect a temperature of the refrigerant and disposed such that if the refrigerant is not circulating through the circuit, the temperature of the refrigerant detected by the temperature detection device in the circuit does not rise even if the external heater is operating, whereas if the refrigerant is circulating through the circuit, the detected temperature of the refrigerant changes. The external heater operation determination system includes a determination device able to determine that the external heater is not operating on a basis (Continued)

of a change in the temperature after the circulation of the refrigerant.

17 Claims, 8 Drawing Sheets

(56) References Cited

U.S. PATENT DOCUMENTS

| | | | | |
|---|---|---|---|---|
| 2010/0043414 | A1* | 2/2010 | Hirose | B60K 6/445 60/320 |
| 2012/0055663 | A1* | 3/2012 | Onozawa | H05B 1/0236 165/266 |

FOREIGN PATENT DOCUMENTS

| | | | |
|---|---|---|---|
| JP | 2011-240777 | A | 12/2011 |
| JP | 2012-057510 | A | 3/2012 |
| JP | 2012-092823 | A | 5/2012 |
| JP | 2012-166709 | A | 9/2012 |

* cited by examiner

EXTERNAL HEATER OPERATION DETERMINATION SYSTEM AND VEHICLE CONTROL SYSTEM

CROSS-REFERENCE TO RELATED APPLICATIONS

The present application claims priority from Japanese Patent Application No. 2017-243338 filed on Dec. 20, 2017, the entire contents of which are hereby incorporated by reference.

BACKGROUND

1. Technical Field

The present invention relates to an external heater operation determination system and a vehicle control system, and more particularly to a system able to determine whether an external heater such as a block heater attached to an engine or the like is operating, and a vehicle control system.

2. Related Art

For instance, in the case in which a vehicle is used in a cold climate or the like, to ensure that the engine starts reliably at low temperatures, in some cases the user externally attaches an external heater such as a block heater to the engine, separately from a heater originally installed in the vehicle or a heater provided by the automobile manufacturer as an optional component. Additionally, by coupling the external heater to an external power outlet to provide power, for instance, the external heater is made to operate and is used to preheat the engine.

Furthermore, whether the engine is being preheated by an external heater (that is, whether an external heater attached to the engine is operating) becomes important information with regard to the execution of various types of control for the vehicle. Accordingly, in the related art, for instance, there exists a determination device that detects engine cooling water with a temperature sensor attached to the engine, and determines whether a block heater is operating on the basis of a deviation between the cooling water temperature and an ambient temperature (see Japanese Unexamined Patent Application Publication (JP-A) No. 2010-101190), and a determination device that determines whether a block heater is being used on the basis of a temperature change in engine coolant when the coolant is circulated (see JP-A No. 2012-57510).

SUMMARY OF THE INVENTION

An aspect of the present invention provides an external heater operation determination system including, in a vehicle: a first device to be heated by an attached external heater; a second device, separate from the first device, to be cooled by a refrigerant; a circulation device configured to circulate the refrigerant through a circuit; and a temperature detection device configured to detect a temperature of the refrigerant. The temperature detection device is disposed such that if the refrigerant is not circulating through the circuit, the temperature of the refrigerant detected by the temperature detection device in the circuit does not rise even if the external heater is operating, whereas if the refrigerant is circulating through the circuit, the temperature of the refrigerant detected by the temperature detection device changes, and the external heater operation determination system includes a determination device able to determine that the external heater is not operating on a basis of a change in the temperature after the circulation of the refrigerant.

An aspect of the present invention provides an external heater operation determination system including, in a vehicle: a first device to be heated by an attached external heater; a second device, separate from the first device, to be cooled by a refrigerant; a circulation device configured to circulate the refrigerant through a circuit; and a temperature detection device configured to detect a temperature of the refrigerant. The temperature detection device is disposed such that if the refrigerant is not circulating through the circuit, the temperature of the refrigerant detected by the temperature detection device in the circuit does not rise even if the external heater is operating, whereas if the refrigerant is circulating through the circuit, the temperature of the refrigerant detected by the temperature detection device changes. The external heater operation determination system includes a determination device able to determine that the external heater is operating on a basis of a change in the temperature after the circulation of the refrigerant.

An aspect of the present invention provides a vehicle control system including the external heater operation determination system; and a temperature sensor malfunction determination device configured to determine whether a malfunction is occurring in a plurality of temperature sensors attached near an engine acting as the first device. The temperature sensor malfunction determination device determines that a malfunction is occurring in any of the plurality of temperature sensors in a case in which a difference between temperatures output from the plurality of temperature sensors exceeds a determination value. In a case in which the determination device of the external heater operation determination system has determined that the external heater is not operating, the temperature sensor malfunction determination device makes the determination using the determination value that is a smaller value than the determination value used otherwise.

BRIEF DESCRIPTION OF THE DRAWINGS

FIG. 10 is a graph explaining change over time in a temperature detected by a temperature sensor, a small determination threshold, a large determination threshold, and the like.

DETAILED DESCRIPTION

Figure 1:
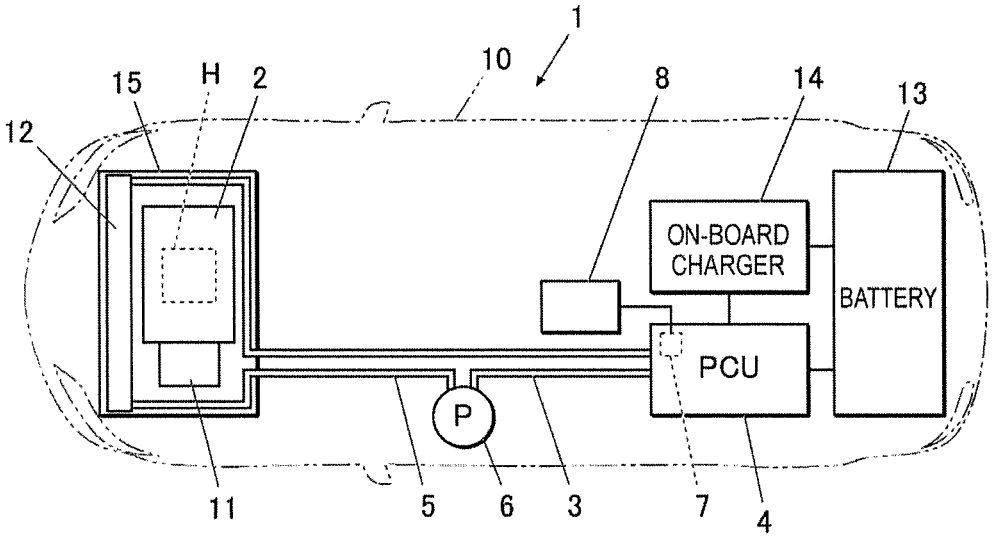
FIG. 1 is a diagram illustrating a configuration of an external heater operation determination system according to an example of the present invention.

Hereinafter, preferred examples of the present invention will be described in detail with reference to the appended drawings. Note that, in this specification and the appended drawings, structural elements that have substantially the same function and structure are denoted with the same reference numerals, and repeated description of these structural elements is omitted.

For instance, the above determination process cannot be executed in a vehicle in which the engine is not started and the circulation of engine cooling water is not started at the point in time when the vehicle enters the Ready-ON state, such as a hybrid electric vehicle (HEV) or a plug-in hybrid electric vehicle (PHEV).

Also, for instance, even if a pump is forcibly activated and the circulation of engine cooling water is started at the point in time when the vehicle enters the Ready-ON state, in the case in which the temperature inside the engine room rises due to the heat of an operating external heater, and the engine cooling water circuit is heated as a whole (in this case, the cooling water inside the circuit is also heated as a whole), obtaining a difference in the temperature distribution of the cooling water at each portion of the circuit becomes difficult.

For this reason, even if the vehicle is configured to forcibly circulate engine cooling water at the point in time when the vehicle enters the Ready-ON state, in the case in which an external heater is operating and the cooling water inside the circuit is heated as a whole, a drop in the water temperature of the cooling water is not observed as above, and whether the external heater is operating may not be determined appropriately in some cases.

It is desirable to provide an external heater operation determination system capable of appropriately determining that an external heater attached to an engine or the like is operating or not operating.

Hereinafter, an external heater operation determination system and a vehicle control system according to an example of the present invention will be described with reference to the drawings.

Note that the following describes an example in which the vehicle is a plug-in hybrid electric vehicle, the external heater is a block heater, a first device that is a target of heating by the attached external heater is an engine, a second device, different from the first device, that is a target of cooling by refrigerant is a power control unit (PCU), the engine is in the front of the vehicle, and the PCU is in the rear of the vehicle. Additionally, after that, extensions to the applicability and the like of an example of the present invention will be described.

[External Heater Operation Determination System]

Hereinafter, an external heater operation determination system according to an example of the present invention will be described. As illustrated in FIG. 1, an external heater operation determination system 1 is equipped with an engine 2 to which a block heater H is attached, a PCU 4 that is a target of cooling by a refrigerant 3, a circuit 5 through which the refrigerant 3 circulates internally, an electric pump 6 that circulates the refrigerant 3 through the circuit 5, a refrigerant temperature sensor 7 that detects the temperature of the refrigerant 3, and a determination device 8, the above being provided inside a vehicle 10.

Inside the vehicle 10, besides the above, components such as a motor 11 that doubles as an electric generator and a radiator 12 for cooling the refrigerant 3 and the like are disposed in the front of the vehicle, while components such as a battery 13 including lithium-ion cells or the like that stores electric energy needed for uses such as the travel of the vehicle 10 and an on-board charger 14 that is coupled to external charging equipment (not illustrated) when the vehicle 10 is stopped and charges the battery 13 are disposed in the rear of the vehicle.

The configuration and the like of the engine 2 and the electric pump 6 is public knowledge, and a description will be omitted. Note that the electric pump 6 is stopped before the activation of the engine 2, and starts to work when a Ready-ON operation is performed by the user and the engine 2 activates as described later (see FIGS. 4 and 6 described later). Also, the working and stopping of the electric pump 6 are executed irrespectively of the operation of the block heater H.

Also, as is well known, when the block heater H is attached at a predetermined position, such as on the underside of the engine 2, and coupled to an external power outlet while the vehicle 10 is stopped, the block heater H generates heat and heats the engine 2. When the vehicle 10 starts moving, the block heater H is detached from the external power outlet. In this way, the heating of the engine 2 by the block heater H is performed while the vehicle 10 is stopped.

Figure 2:
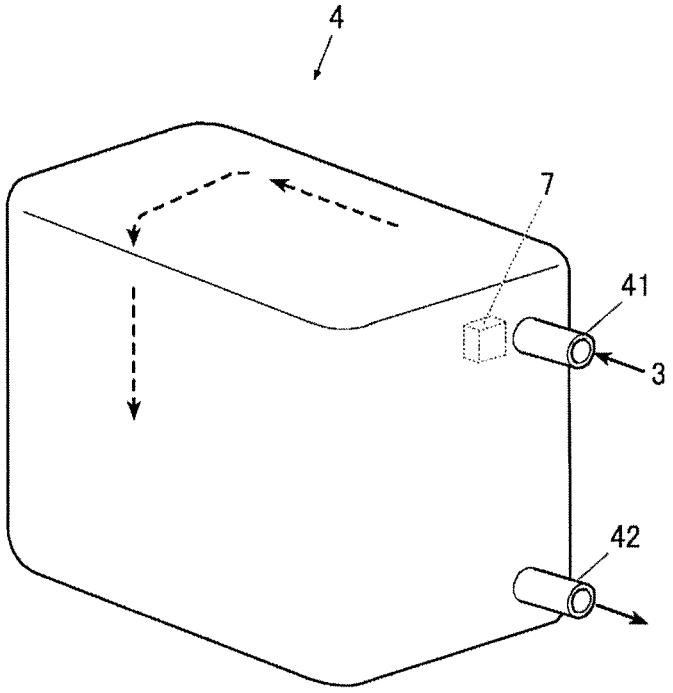
FIG. 2 is a perspective view illustrating a configuration of a PCU.

The PCU 4 is a piece of electric equipment that controls the output and the like of the battery 13 for driving the motor 11, and is provided with a step-up converter that raises the voltage of the battery 13, an inverter that converts DC voltage to AC voltage, and the like. Additionally, since the PCU 4 generates heat while working, as illustrated in FIG. 2, pipes (included as part of the circuit 5) through which the refrigerant 3 flows are disposed inside the PCU 4 to cool the PCU 4 effectively. Additionally, the refrigerant 3 flowing through the circuit 5 on the outside of the PCU 4 flows in from a refrigerant inlet 41 provided on the PCU 4, and flows out from a refrigerant outlet 42 to feed into the circuit 5 on the outside.

Also, normally, multiple refrigerant temperature sensors (or a single refrigerant temperature sensor) that detect the temperature of the refrigerant 3 flowing inside the PCU 4 are provided inside the PCU 4, but in this example, among such sensors, the refrigerant temperature sensor closest to the refrigerant inlet 41 is used as the refrigerant temperature sensor 7 described above. For this reason, in this example, a temperature T of the refrigerant 3 flowing into the PCU 4 is detected by the refrigerant temperature sensor 7.

Information about the temperature T of the refrigerant 3 detected by the refrigerant temperature sensor 7 is originally used by the PCU 4 itself, but in this example, information about the temperature T of the refrigerant 3 is also transmitted to the determination device 8 and used in the determination process described later in the determination device 8. Note that in FIG. 1, the determination device 8 is illustrated as being a separate device from the PCU 4, but the determination device 8 may also be built into the PCU 4. Furthermore, it is also possible for the determination device 8 to be built into an engine control unit (ECU) or the like not illustrated, or configured as a control unit or the like that is separate from the other control units.

On the other hand, in this example, a case in which cooling water 3 is used as the refrigerant 3 is assumed, but the refrigerant 3 may also be another refrigerant such as a cooling oil or a cooling gas. Also, in this example, as the circuit 5 of the refrigerant 3, a refrigerant circuit originally disposed in the vehicle 10 to cool the PCU 4 is used.

In this case, the refrigerant 3 circulates through the PCU 4 as above, is drawn into the engine room 15 via the circuit 5, and is cooled by the radiator 12. At this time, if the block heater H is operating while the vehicle 10 is stopped as above, since the temperature inside the engine 2 and the engine room 15 becomes higher, the refrigerant 3 inside the circuit 5 is heated inside the engine room 15, and the temperature of the refrigerant 3 rises. However, since the heat of the block heater H does not reach the outside of the engine room 15, or at least does not reach the PCU 4 in the rear of the vehicle, the temperature of the refrigerant 3 inside the circuit 5 does not rise in the portion on the outside of the engine room 15 (at least in the portion of the PCU 4), and becomes the same (or nearly the same) temperature as the ambient temperature. Note that it is not strictly necessary to use a circuit for cooling the PCU 4 like in this example as the circuit 5 of the refrigerant 3.

Additionally, in the example of the present invention, the refrigerant temperature sensor 7 (temperature detection device) is disposed such that if the refrigerant 3 is not circulating through the circuit 5, the temperature T of the refrigerant 3 detected by the refrigerant temperature sensor 7 in the circuit 5 does not rise even if the block heater H (external heater) is operating, whereas if the refrigerant 3 is circulating through the circuit 5, the temperature T of the refrigerant 3 detected by the refrigerant temperature sensor 7 changes. Hereinafter, a specific description will be given.

[Determination Process in Determination Device]

Next, the determination process in the determination device 8 of the external heater operation determination system 1 will be described specifically. In this example, the determination device 8 is configured to execute a determination process on the basis of a post-circulation change ΔT in the temperature T when the temperature T of the refrigerant 3 detected by the refrigerant temperature sensor 7 changes due to the circulation of the refrigerant 3 through the circuit 5.

Figure 3A:
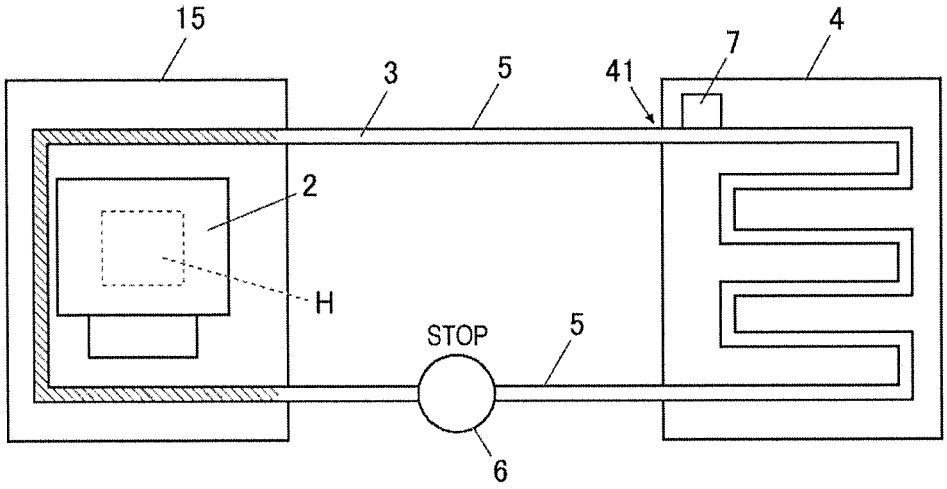
FIG. 3A is a representative diagram illustrating a state in which refrigerant inside a circuit in an engine room is heated.

In this example, when the block heater H is operating, if the vehicle 10 is in a soak state (a state in which the engine 2 and the motor 11 are both stopped, and the vehicle 10 has been left alone (stopped) for a sufficiently long time) and the refrigerant 3 is not circulating, as illustrated in FIG. 3A, the temperature of the refrigerant 3 (see the shaded part of the diagram) in the circuit 5 inside the engine room 15 becomes higher due to the heat of the engine 2 and the like heated by the block heater H, but the temperature (the temperature T detected by the refrigerant temperature sensor 7) of the refrigerant 3 in the circuit 5 on the PCU 4 side has lowered to be approximately the same as the ambient temperature.

Figure 3B:
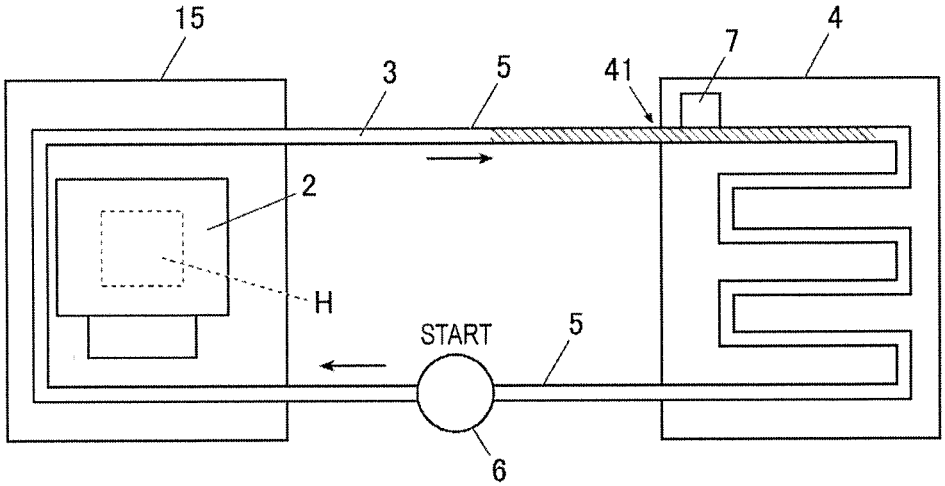
FIG. 3B is a representative diagram illustrating a state in which refrigerant heated by the action of an electric pump circulates and flows into the PCU.

Additionally, in this state, if the user performs a Ready-ON operation, the electric pump 6 activates, and the refrigerant 3 begins to circulate through the circuit 5, as illustrated in FIG. 3B, since the refrigerant 3 (see the shaded part of the diagram) heated inside the engine 2 and the like in the engine room 15 (hereinafter, "inside the engine 2 and the like in the engine room 15" will be collectively designated "inside the engine room 15") flows into the PCU 4 originally containing the refrigerant 3 of low temperature, the temperature T of the refrigerant 3 detected by the refrigerant temperature sensor 7 rises suddenly.

On the other hand, if the block heater H is not operating, since the refrigerant 3 is not heated inside the engine room 15, a sudden rise in the temperature T of the refrigerant 3 inside the PCU 4 does not occur even if the refrigerant 3 is circulated. Accordingly, in this example, the determination device 8 uses these phenomena to execute the determination process.

In the following, for the sake of convenience, a case of determining that the block heater H is operating (Exemplary Configuration 1) and a case of determining that the block heater H is not operating (Exemplary Configuration 2) on the basis of the change ΔT in the temperature T of the refrigerant 3 detected by the refrigerant temperature sensor 7 will be described separately.

Exemplary Configuration 1

Figure 4:
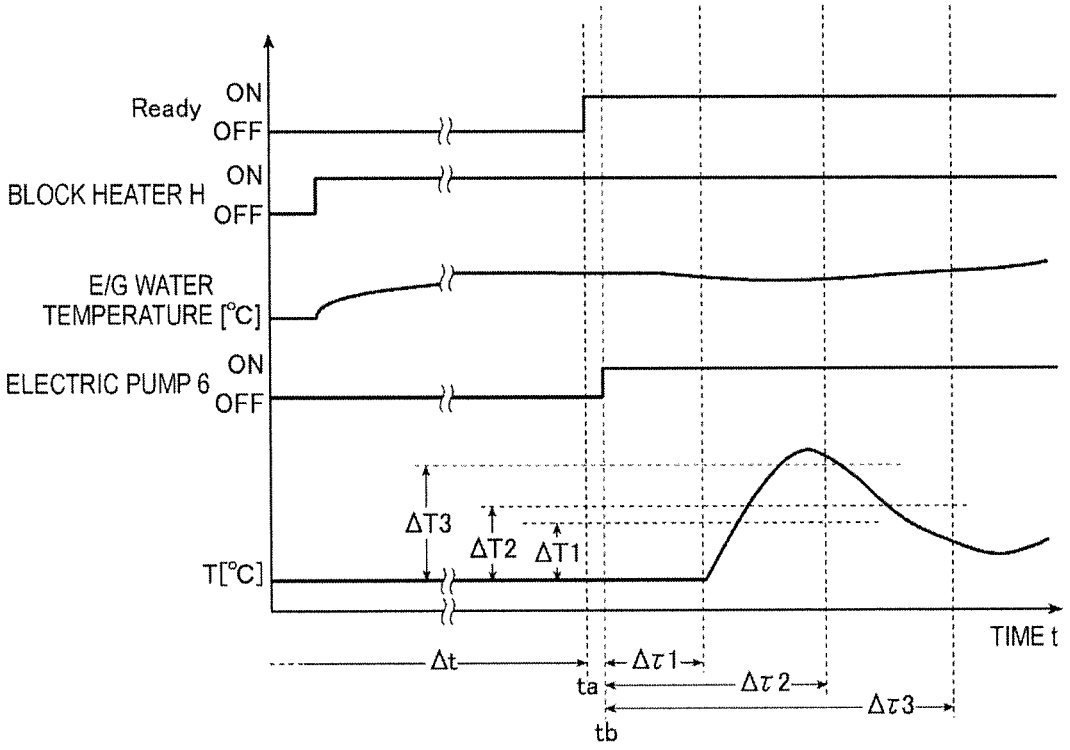
FIG. 4 is a graph illustrating change over time and the like in the temperature of refrigerant in a circuit inside the PCU and inside the engine room before and after a Ready-ON operation in the case in which a block heater operates.
Figure 5:
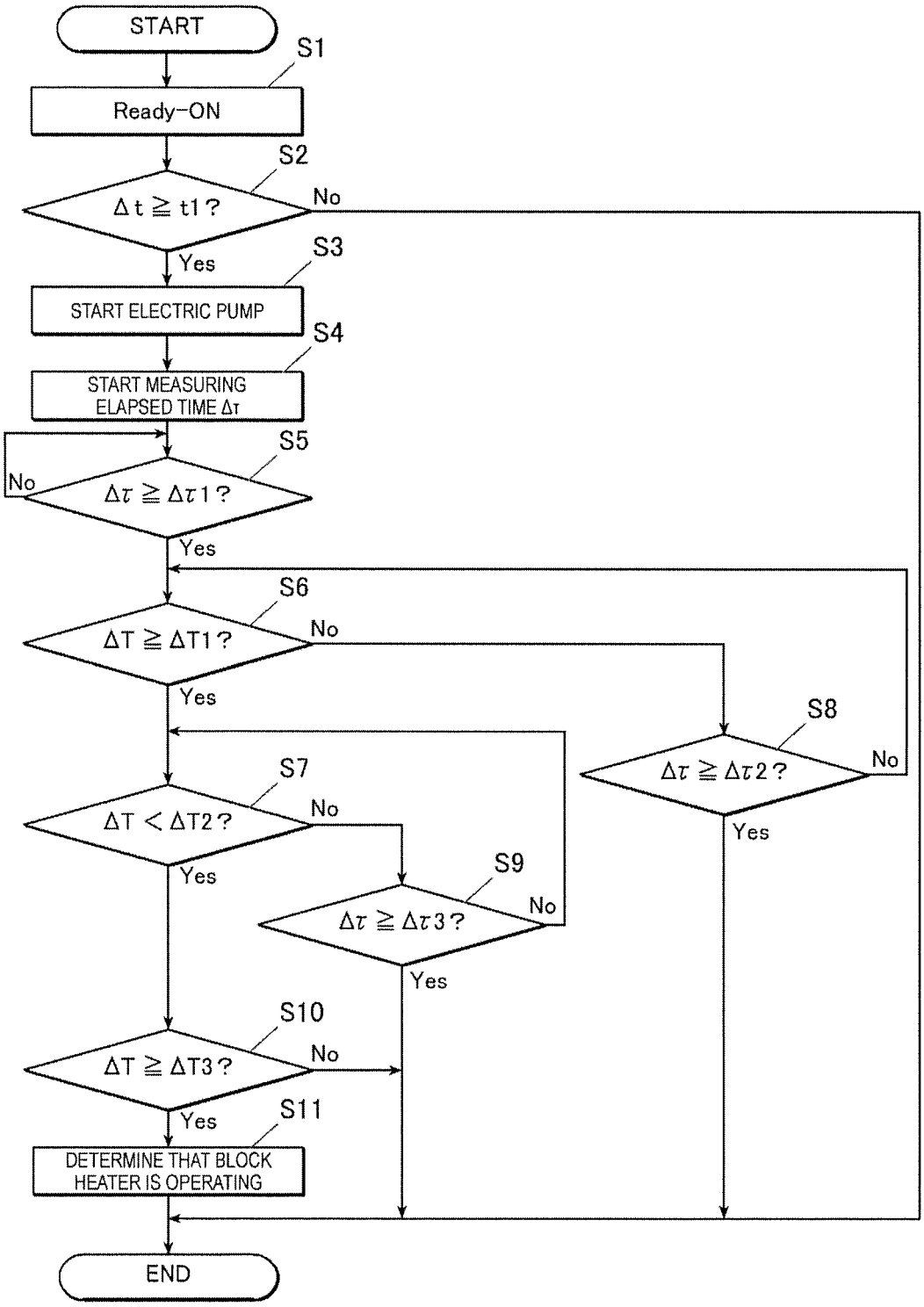
FIG. 5 is a flowchart illustrating the flow of each process and the like executed in Exemplary Configuration 1.

First, Exemplary Configuration 1 will be described specifically on the basis of the graph in FIG. 4, the flowchart in FIG. 5, and the like. FIG. 4 is a graph illustrating change over time in the temperature of the refrigerant 3 in the circuit 5 inside the PCU 4 and change over time in the temperature of the refrigerant 3 in the circuit 5 inside the engine room 15 before and after a Ready-ON operation is performed by the user (see time ta). Note that in FIG. 4, instead of the temperature of the refrigerant 3 in the circuit 5 inside the engine room 15, the temperature (E/G water temperature) of cooling water in the engine measured by a temperature sensor (not illustrated) attached to the engine 2 is illustrated. Additionally, in FIG. 4, the timings of Ready-ON/OFF, the ON/OFF of the block heater H, and the ON/OFF of the electric pump 6 (that is, running/stopped) are also illustrated.

As described earlier, since the block heater H generates heat when coupled to an external power outlet and turned ON while the vehicle 10 is stopped, the cooling water of the engine 2 is heated, the engine 2 heats up, and the temperature of the refrigerant 3 (indicated by proxy as the E/G water temperature in FIG. 4) in the portion of the circuit 5 inside the engine room 15 rises. Subsequently, when the amount of heat provided by the block heater H and the amount of heat radiated from the engine 2 become approximately equal, the temperature of the engine 2 becomes nearly constant.

However, since the PCU 4 does not run unless the user performs a Ready-ON operation or the battery 13 is charged via the on-board charger 14 (see FIG. 1) while the vehicle 10 is in a soak state, the temperature of the PCU 4 does not rise, and becomes the same temperature (or nearly the same temperature; the same applies hereinafter) as the ambient temperature. Also, since the refrigerant 3 does not circulate through the circuit 5 unless the electric pump 6 is activated, even if the block heater H attached to the engine 2 as above operates and generates heat while the vehicle 10 is in a soak state, the temperature T of the refrigerant 3 inside the PCU 4 stays the same temperature as the ambient temperature and remains low.

With this arrangement, in this example, in the case in which the block heater H is operating while the vehicle 10 is in a soak state, the temperature distribution of the refrigerant 3 becomes one in which the temperature of the refrigerant 3 becomes higher in the circuit 5 inside the engine room 15, but in the portion of circuit 5 inside the PCU 4, the temperature T of the refrigerant 3 remains a low temperature approximately equal to the ambient temperature. In other words, the temperature distribution illustrated in FIG. 3A described earlier is formed. Additionally, to execute the determination process of determining that the block heater H is operating on the basis of the change ΔT in the temperature T of the refrigerant 3 detected by the refrigerant temperature sensor 7, it is presupposed that such a temperature distribution of the refrigerant 3 occurs while the vehicle 10 is in a soak state.

Furthermore, for such a temperature distribution to occur, it is at least necessary for a long time to have passed since the stopping of the PCU 4 whose temperature rises while the PCU 4 is active, and for the temperature of the PCU 4 to fall sufficiently. In other words, even if the PCU 4 stops running, if the temperature of the PCU 4 is high, the refrigerant 3 not only inside the engine room 15 but also inside the PCU 4 will still be in a hot state, and therefore a temperature distribution of the refrigerant 3 like the above will no longer occur, or even if the temperature distribution does occur, the temperature difference will be slight, making it difficult to execute the above determination process.

Also, even if the temperature of the PCU 4 has fallen sufficiently, if the battery 13 is charged via the on-board charger 14 or the like as described above, the electric pump 6 is activated while the vehicle 10 is in a soak state, and the refrigerant 3 is circulated through the circuit 5, even though the temperature PCU 4 had fallen sufficiently, the refrigerant 3 inside the engine room 15 heated by the heat of the block heater H will circulate through the circuit 5 and mix with the cool refrigerant 3. For this reason, the refrigerant 3 inside the circuit 5 will have a mostly uniform temperature throughout all portions of the circuit 5. In other words, the temperature distribution of the refrigerant 3 as described above will no longer occur, making it difficult to execute the determination process in this case as well.

Accordingly, in this example, when the user performs a Ready-ON operation (step S1 in FIG. 5; time ta in the graph of FIG. 4), the determination device 8 references a history or the like of the activation and stopping of the PCU 4 and the electric pump 6, and judges whether a duration Δt (see FIG. 4) of a state in which both the PCU 4 and the electric pump 6 were stopped until the Ready-ON operation has continued for a predetermined time t1 or more (step S2).

Note that, for instance, it is also possible to measure the duration Δt with a timer not illustrated. In this case, if the timer is activated while the vehicle 10 is in a soak state, and the timer is reset every time the PCU 4 or the electric pump 6 is activated, the time measured by the time will express the duration Δt of the state during which both the PCU 4 and the electric pump 6 were stopped.

Here, the above predetermined time t1 is preset on the basis of the time taken from when the working of the PCU 4 stops until the temperature is lowered sufficiently (this time being different depending on the configuration and the like of the PCU 4), the time after activating the electric pump 6 in a state in which the engine 2 is heated by the block heater H (the PCU 4 is stopped) and mixing the refrigerant 3 inside the circuit 5 from when the working of the electric pump 6 stops until reaching a state in which the above temperature distribution occurs (until the temperature T of the refrigerant 3 in the PCU 4 portion is lowered sufficiently) (this time being different depending on the performance of the electric pump 6, the configuration of the circuit 5, and the like), and the like.

Subsequently, if the duration Δt of the above state is less than the predetermined time t1 (step S2: No), there is a high likelihood that executing the determination process as above will be difficult, and there is a possibility that even if the determination device 8 executes the determination process, the determination device 8 may be unable to execute the process correctly, or that the determination device 8 may incorrectly determine that the block heater H is operating even though the block heater H is not actually operating. For this reason, in this case, the determination process ends (the determination process is not executed) at this point in time. Also, in the case in which the duration Δt of the above state is the predetermined time t1 or greater (step S2: Yes), the determination device 8 starts the determination process.

The period from when the user performs a Ready-ON operation until the vehicle 10 actually enters the Ready-ON state and the electric pump 6 and the like start to work normally takes approximately 1 second, and during this period, initial operations are performed by each electronic control unit and the like inside the vehicle 10. Additionally, for instance, in the initial operations, the electronic control unit of the PCU 4 performs a check of whether the electric pump 6, the refrigerant temperature sensor 7, and the like are operating correctly and the like.

Additionally, during this period, the determination device 8 may also be configured to check whether a device or the like involved in the determination process is operating correctly and obtain relevant information from each electronic control unit and the like as appropriate. Note that, although omitted from illustration, the determination device 8 is configured to stop the determination process in cases such as when some kind of abnormality occurs and the determination device 8 becomes unable to execute the determination process correctly, on the basis of the result of a check of another electronic control unit, the result of a self-check, and the like.

Additionally, if the initial operations are completed without an abnormality, the electronic control unit of the PCU 4 activates the refrigerant temperature sensor 7 and also activates the electric pump 6 (step S3; see time tb in FIG. 4). For this reason, the refrigerant 3 begins to circulate through the circuit 5. Immediately before the electric pump 6 starts to work, or at the point in time when the electric pump 6 starts to work, the determination device 8 records the temperature T (initial temperature T0) of the refrigerant 3 detected by the refrigerant temperature sensor 7.

Subsequently, when the refrigerant 3 circulates through the circuit 5, at the circulation start time, the temperature of the refrigerant 3 detected by the refrigerant temperature sensor 7 is a low value approximately equal to the ambient temperature, but as illustrated in FIG. 3B, when the refrigerant 3 heated inside the engine room 15 flows into the PCU 4, the temperature T of the refrigerant 3 rises suddenly. Additionally, as the refrigerant 3 circulates further, the hot refrigerant 3 that has flowed into the PCU 4 flows out from the PCU 4, and refrigerant 3 of a lower temperature (that is, refrigerant 3 not heated in the engine room 15) flows into the PCU 4.

For this reason, as illustrated in FIG. 4, after the electric pump 6 activates, a pulse in which the temperature rises briefly and then falls occurs in the temperature T of the refrigerant 3 detected by the refrigerant temperature sensor 7 of the PCU 4. In this example, in this way, the determination device 8 treats a pulse occurring in the temperature T of the refrigerant 3 detected by the refrigerant temperature sensor 7 as one requisite in the determination process of determining that the block heater H is operating.

Specifically, in the case in which the change ΔT in the temperature T of the refrigerant 3 detected by the refrigerant temperature sensor 7 (that is, the difference between the temperature T of the refrigerant 3 detected by the refrigerant temperature sensor 7 and the above initial temperature T0) increases to become a first threshold ΔT1 or greater (step S6:

Yes), and after that, the briefly risen temperature of the refrigerant 3 falls, and the change ΔT in the temperature of the refrigerant 3 becomes less than a second threshold ΔT2 (step S7: Yes), the determination device 8 executes each judgment process in step S10 and thereafter described later, whereas in the case in which the above conditions are not satisfied, the determination device 8 ends the determination process.

On the other hand, in this example, a time limit is imposed when executing judgment processes such as steps S6 and S7, such that the change in the temperature T of the refrigerant 3 satisfies the above conditions only in the case in which the block heater H is operating (that is, such that the change in the temperature T of the refrigerant 3 does not satisfy the above conditions in the case in which the block heater H is not operating).

Specifically, when the electric pump 6 is activated as above (step S3), the determination device 8 resets the timer, and starts measuring an elapsed time Δτ since the activation of the electric pump 6 (step S4). Note that, instead of treating the activation of the electric pump 6 as the start point, the measurement of the elapsed time t1 may also be started from the point in time when the user performs the Ready-ON operation (as described above, there is only a fixed time difference of approximately 1 second between these points in time).

Additionally, in the state illustrated in FIG. 3A, even if the electric pump 6 is activated and the circulation of the refrigerant 3 begins, while the refrigerant 3 heated inside the engine room (see the shaded part of the diagram) has not yet reached the refrigerant temperature sensor 7 inside the PCU 4, even if the change ΔT in the temperature T of the refrigerant 3 detected by the refrigerant temperature sensor 7 satisfies each condition above for some reason (steps S6, S7: Yes), this change is not caused by the operation of the block heater H. For this reason, during this period, if the change ΔT in the temperature T of the refrigerant 3 satisfies each condition above (steps S6, S7: Yes) and thereby it is determined that the block heater H is operating, a false determination occurs.

Accordingly, in this example, to avoid such a false determination, the determination device 8 does not execute the judgment processes in steps S6 and S7 (step S5: No) until the above elapsed time Δτ (that is, the elapsed time Δτ since the activation of the electric pump 6) passes a predetermined elapsed time Δτ1, and at the point in time when the predetermined elapsed time Δτ1 passes (step S5: Yes), the determination device 8 executes each of the processes in step S6 and thereafter.

The above predetermined elapsed time Δτ1 (step S5; see FIG. 4) is set to the minimum time from the activation of the electric pump 6 in the state of FIG. 3A until the refrigerant 3 heated inside the engine room 15 reaches the refrigerant temperature sensor 7 inside the PCU 4. With this configuration, it becomes possible to appropriately prevent the occurrence of a false determination like the above.

Additionally, in this example, a time limit is also imposed on the judgment process in the above step S6 (step S8). In other words, a time limit is also imposed on the process of judging whether the change ΔT in the temperature T of the refrigerant 3 detected by the refrigerant temperature sensor 7 is equal to or greater than the first threshold ΔT1.

As above, when the user performs a Ready-ON operation and the vehicle 10 enters the Ready-ON state, since the PCU 4 activates and generates heat, even if the block heater H is not operating, the temperature T of the refrigerant 3 circulating through the circuit 5 rises (note that although the refrigerant 3 is heated by the PCU 4 and the like, since heat is radiated by the radiator 12 and the like, the temperature of the refrigerant 3 eventually converges on an approximately constant temperature). Additionally, when the temperature T of the refrigerant 3 rises in this way, there is a possibility that the change ΔT in the temperature T of the refrigerant 3 will become equal to or greater than the first threshold ΔT1 at any point in time (step S6: Yes), and if it is thereby determined that the block heater H is operating, a false determination will occur.

In this example, to avoid such a false determination, during the period after the elapsed time Δτ from the activation of the electric pump 6 as above reaches the predetermined elapsed time Δτ1 (step S5: Yes) until a predetermined elapsed time Δτ2 passes, in the case in which the change ΔT of the temperature T of the refrigerant 3 has not become the threshold ΔT1 or greater (step S6: No), the determination device 8 ends the determination process at the point in time when the elapsed time Δτ becomes the predetermined elapsed time Δτ2 (step S8: Yes).

In this case, the elapsed time Δτ2 (step S8; see FIG. 4) is set to an appropriate time that is longer than a maximum time from the activation of the electric pump 6 in the state illustrated in FIG. 3A for instance until the refrigerant 3 whose temperature has been risen by the heat of the block heater inside the engine room 15 reaches the refrigerant temperature sensor 7 of the PCU 4 (that is, for instance, the time until the refrigerant 3 that is farthest away from the refrigerant temperature sensor 7 from among the refrigerant 3 with a risen temperature reaches the refrigerant temperature sensor 7). The appropriate time is decided by conducting experiments or the like in advance.

Also, for instance, a maximum change ΔT by which the temperature T of the refrigerant 3 may rise within the above elapsed time Δτ2 in the state in which the block heater H is not made to operate is inferred by experiment in advance (or computed by mathematical operations or the like), and the above first threshold ΔT1 (step S6; see FIG. 4) is preset to a larger value. Note that as described above, since the PCU 4 generates heat when activated, the temperature T of the refrigerant 3 rises even when the block heater H is not operating. In other words, the first threshold ΔT1 is set as a change ΔT in the temperature T of the refrigerant 3 such that the change ΔT in the temperature T of the refrigerant 3 becomes the first threshold ΔT1 or greater within the elapsed time Δτ2 only in the case in which the block heater H is operating.

Subsequently, in the case in which the above elapsed time Δτ2 passes (step S8: Yes), and even though the refrigerant 3 heated inside the engine room 15 should have already passed the position of the refrigerant temperature sensor 7 inside the PCU 4, the change ΔT in the temperature T of the refrigerant 3 detected by the refrigerant temperature sensor 7 has not become equal to or greater than the first threshold ΔT1 (step S6: No), it may be determined that the block heater H is not operating. In this way, by setting the elapsed time Δτ2 and the first threshold ΔT1 as above, it becomes possible to appropriately distinguish between the case in which there is a possibility that the block heater H is operating and the case in which there is no such possibility (that is, the block heater H is not operating).

Additionally, in Exemplary Configuration 1, in the case in which the state of the change ΔT in the temperature T of the refrigerant 3 not being equal to or greater than the first threshold ΔT1 (step S6: No) continues for the elapsed time Δτ2 or longer (step S8: Yes), the determination device 8 does not determine that the block heater H is operating (in this case, the determination device 8 also does not determine that the block heater H is not operating).

Additionally, in this example, a time limit additionally is imposed on the judgment process in the above step S7 (step S9). In other words, after the change ΔT in the temperature T of the refrigerant 3 becomes equal to or greater than the first threshold ΔT1 (step S6: Yes), in the case in which the state of the change ΔT in the temperature T of the refrigerant 3 not being less than the second threshold ΔT2 (step S7: No) continues for a predetermined elapsed time Δτ3 or longer (step S9: Yes), the determination device 8 ends the determination process at this point in time. The second threshold ΔT2 may be the same value as the first threshold ΔT1.

In this case, the above elapsed time Δτ3 and the second threshold ΔT2 (steps S8 and S9; see FIG. 4) are set to appropriate values found by experiment in advance or the like to enable the determination that a pulse has occurred in which the temperature T of the refrigerant 3 rises briefly and then falls, and the change ΔT in the temperature T of the refrigerant 3 has become sufficiently small.

In the case in which the change ΔT in the temperature T of the refrigerant 3 does not fall to less than the second threshold ΔT2 even after the above elapsed time Δτ3 passes (step S7: No, step S9: Yes), since the electric pump 6 is working normally (in cases in which the electric pump 6 is not working normally, the determination device 8 does not execute the determination process in the first place), there is a possibility that some kind of abnormality, such as an obstruction in the circuit 5, has occurred. Additionally, in such a case, it is highly possible that a suitable determination result will not be obtained even if the determination process is forced to continue.

For this reason, in the case in which the state of the change ΔT in the temperature T of the refrigerant 3 not falling to less than second threshold ΔT2 (step S7: No) continues for the elapsed time Δτ3 or longer (step S9: Yes), the determination device 8 does not determine that the block heater H is operating (in this case, the determination device 8 also does not determine that the block heater H is not operating).

In this example, as above, the determination device 8 proceeds to each process in step S10 and thereafter only in the case in which, under the limits of the elapsed times Δτ (Δτ2, Δτ3), the change ΔT in the temperature T of the refrigerant 3 briefly rises to the first threshold ΔT1 or higher (step S6: Yes) and then falls to less than the second threshold ΔT2 (step S7: Yes; in other words, the case in which there is a pulse in the temperature T of the refrigerant 3).

On the other hand, as one more requisite for the case of determining that the block heater H is operating, in this example, during the period after the change ΔT in the temperature T of the refrigerant 3 becomes the above first threshold ΔT1 or greater (step S6: Yes) until falling to less than the second threshold ΔT2 (step S7: Yes), in the case in which the change ΔT in the temperature T of the refrigerant 3 becomes equal to or greater than a third threshold ΔT3 (see FIG. 4) set to a larger value than the first threshold ΔT1 and the like (step S10: Yes), the determination device 8 ultimately determines that the block heater H is operating (step S11).

This judgment process (step S10) is a process for eliminating cases in which a pulse occurs in the temperature T of the refrigerant 3 as above, but the pulse is not caused by the operation of the block heater H. Additionally, in this case, the above third threshold ΔT3 is set to a value that the change ΔT in the temperature T of the refrigerant 3 would reach plausibly in the case in which the block heater H is being used in a normal usage state and is operating, but would not reach plausibly in other cases.

With this configuration, the determination device 8 is able not to determine that the block heater H is operating in the case in which the change ΔT in the temperature T of the refrigerant 3 does not become equal to or greater than the third threshold ΔT3 (step S10: No) because the pulse in the temperature T of the refrigerant 3 has been caused by something other than the operation of the block heater H. In this case, the determination process ends.

Also, in the case in which the change ΔT in the temperature T of the refrigerant 3 becomes equal to or greater than the third threshold ΔT3 (step S10: Yes) because the pulse in the temperature T of the refrigerant 3 has been caused by the operation of the block heater H, the determination device 8 becomes able to distinguish this state appropriately, and appropriately determine that the block heater H is operating (step S11).

With a configuration like the above, the determination device 8 becomes able to appropriately determine that the block heater H is operating in the case in which the block heater H is operating, without making a false determination that block heater H is operating in the case in which the block heater H is not operating.

Exemplary Configuration 2

Exemplary Configuration 1 above describes a case in which the determination device 8 appropriately determines that the block heater H is operating on the basis of the change ΔT in the temperature T of the refrigerant 3, but it is similarly possible for the determination device 8 to appropriately determine that the block heater H is not operating on the basis of the change ΔT in the temperature T of the refrigerant 3.

In this case, if the block heater H is not operating while the vehicle 10 is in a soak state, a temperature distribution of the refrigerant 3 as illustrated in FIGS. 3A and 3B does not occur inside the circuit 5, and the temperature of the refrigerant 3 becomes a temperature equal (or nearly equal; the same applies hereinafter) to the ambient temperature throughout the entirety of the circuit 5 (although there may be some slight temperature differences).

Figure 6:
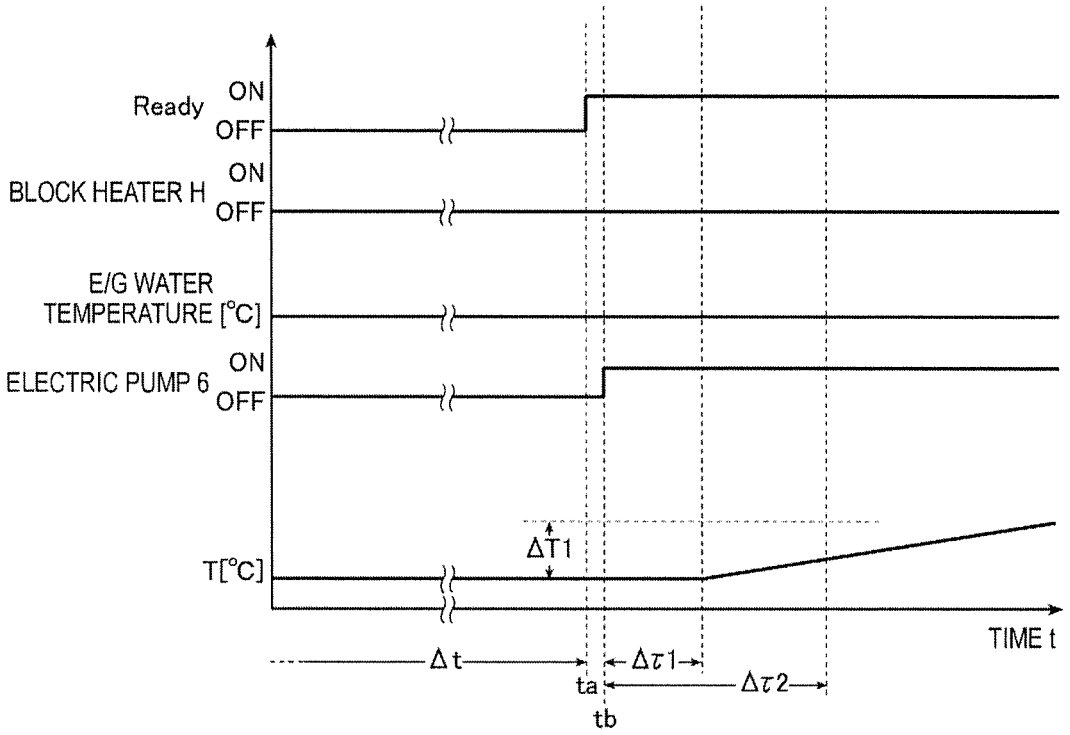
FIG. 6 is a graph illustrating change over time and the like in the temperature of refrigerant in a circuit inside the PCU and inside the engine room before and after a Ready-ON operation in the case in which a block heater does not operate.

For this reason, if the user performs a Ready-ON operation and the electric pump 6 is activated in this state, the temperature T of the refrigerant 3 detected by the refrigerant temperature sensor 7 does not rise suddenly like in the case in which the block heater H is operating illustrated in FIG. 4, and instead the detected temperature T of the refrigerant 3 continues in a constant state (that is, a state in which a temperature equal to the ambient temperature is detected). Additionally, as described earlier, since the PCU 4 generates heat when activated, as illustrated in FIG. 6, the temperature T of the refrigerant 3 rises gradually even if the block heater H is not operating.

Additionally, in such a situation, as indicators for determining that the block heater H is not operating, it is possible to use the first threshold ΔT1 in the judgment process of step S6 and the elapsed time Δτ2 (see step S8) related to a time limit on this judgment process in Exemplary Configuration 1 (see FIG. 5), for instance.

Figure 7:
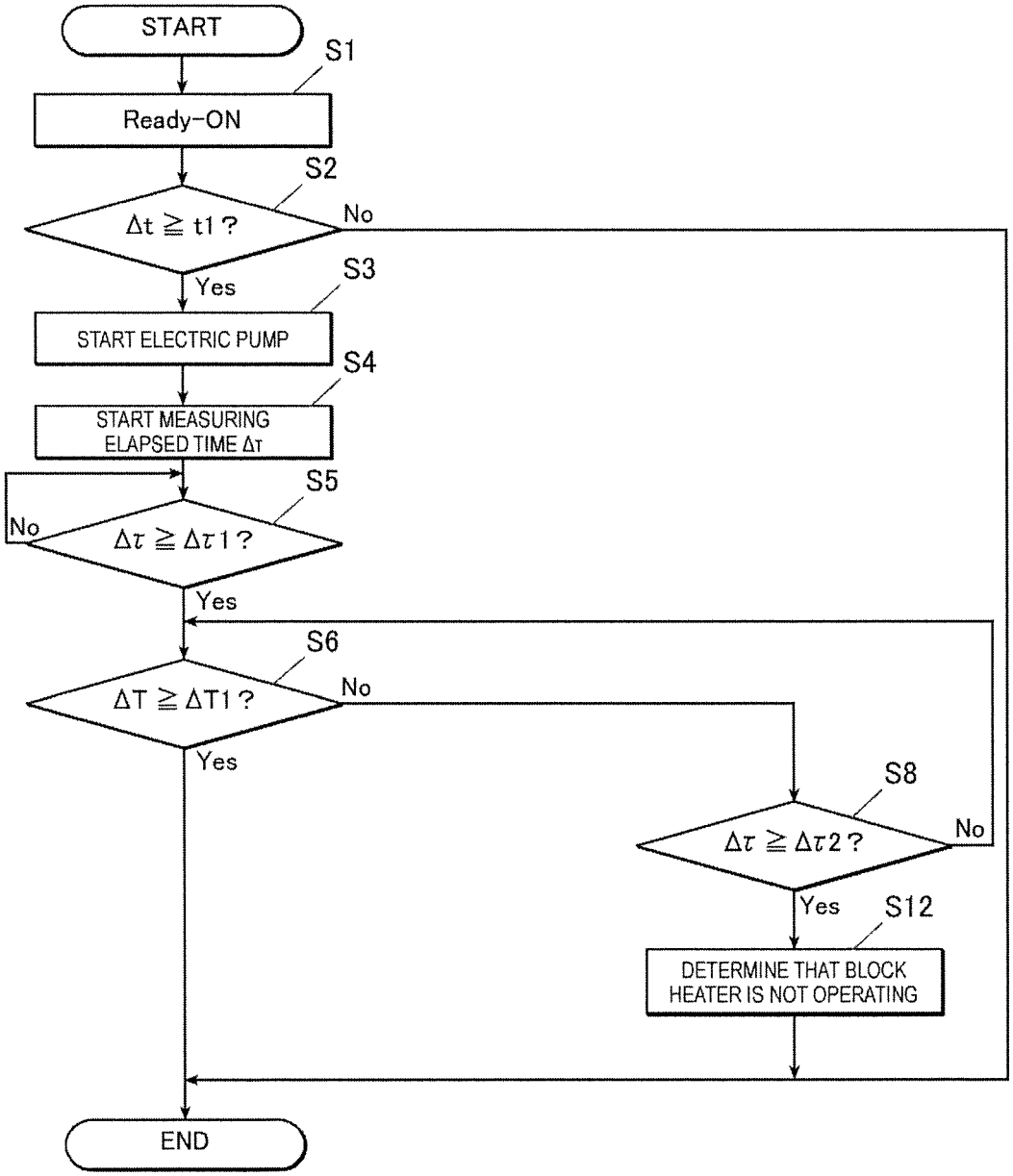
FIG. 7 is a flowchart illustrating the flow of each process and the like executed in Exemplary Configuration 2.

An instance of a flowchart of the determination process for such a configuration is illustrated in FIG. 7. Note that in this case, step S1 to S6 and S8 may be configured similarly to the case of Exemplary Configuration 1 above. Also, in the case of Exemplary Configuration 2, since the determination device 8 determines that the block heater H is not operating, each process in step S7 and steps S9 to S11 for determining that the block heater H is operating illustrated in FIG. 5 is not executed.

As described in Exemplary Configuration 1 above, the elapsed time Δτ2 in the judgment process of step S8 (see FIG. 6) is set to, for instance, an appropriate time that is longer than a maximum time from the activation of the electric pump 6 until the refrigerant 3 in the circuit 5 inside the engine room 15 reaches the refrigerant temperature sensor 7 of the PCU 4 (that is, for instance, the time until the refrigerant 3 that is farthest away from the refrigerant temperature sensor 7 from among the refrigerant 3 in the circuit 5 inside the engine room 15 reaches the refrigerant temperature sensor 7).

Also, for instance, a maximum change ΔT by which the temperature T of the refrigerant 3 may rise within the above elapsed time Δ-2 in the state in which the block heater H is not made to operate is inferred by experiment in advance (or computed by mathematical operations or the like), and the above first threshold ΔT1 (see FIG. 6) in the judgment process of step S6 is preset to a larger value.

With such a configuration, at the point in time when the above elapsed time Δτ2 has passed (step S8: Yes), all of the refrigerant 3 that had been inside the engine room 15 when the electric pump 6 was activated should have already passed the position of the refrigerant temperature sensor 7 inside the PCU 4, but if the change ΔT in the temperature T of the refrigerant 3 detected by the refrigerant temperature sensor 7 during this period does not become equal to or greater than the first threshold ΔT1 (step S6: No), it may be determined that the refrigerant 3 has not been heated by the block heater H, and that the block heater H is not operating.

For this reason, in Exemplary Configuration 2, as illustrated in FIG. 7, in the case in which the state of the change ΔT in the temperature T of the refrigerant 3 not being equal to or greater than the first threshold ΔT1 (step S6: No) continues for the elapsed time Δτ2 or longer (step S8: Yes), the determination device 8 determines that the block heater H is not operating (step S12).

With a configuration like the above, the determination device 8 becomes able to reliably determine that the block heater H is not operating in the case in which the block heater H is not operating, without making a false determination that block heater H is not operating in the case in which the block heater H is operating.

Note that in Exemplary Configuration 2, it is not necessary to configure each process in steps S1 to S6 and S8 as above similarly to Exemplary Configuration 1, and insofar as the process is able to determine that the block heater H is not operating on the basis of the change ΔT in the temperature T of the refrigerant 3 when the temperature T of the refrigerant 3 detected by the refrigerant temperature sensor 7 changes in association with the circulation of the refrigerant 3 through the circuit 5, it is also possible to configured the determination device 8 to execute a determination process with another configuration.

Exemplary Configuration 3

Figure 8:
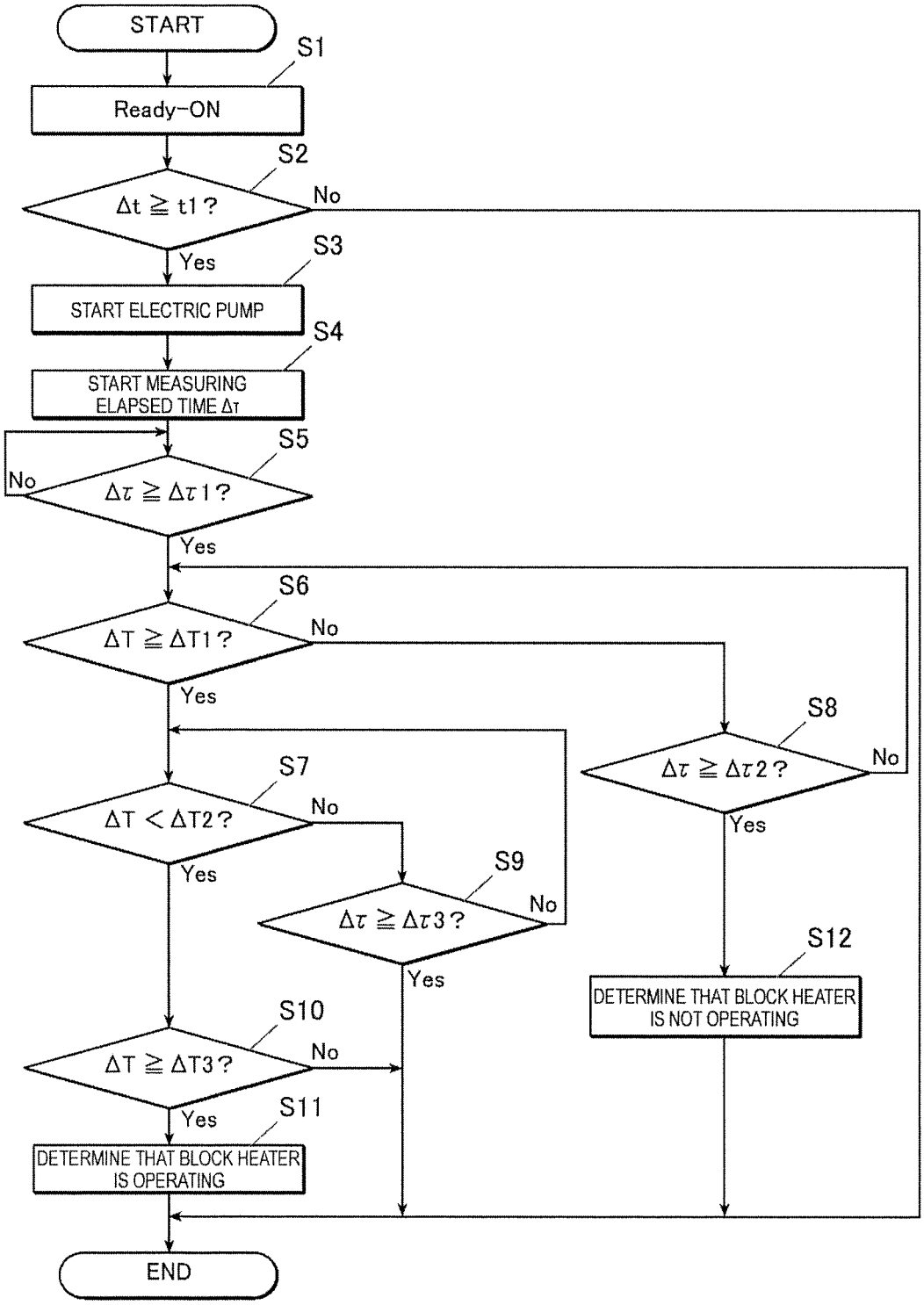
FIG. 8 is a flowchart illustrating the flow of each process and the like executed in Exemplary Configuration 3.

On the other hand, as described above, in the case in which each process in steps S1 to S6 and S8 in Exemplary Configuration 2 is configured similarly to Exemplary Configuration 1 as above, for instance, Exemplary Configuration 1 and Exemplary Configuration 2 may be combined into a single flowchart as illustrated in FIG. 8, and during a single determination process in the determination device 8, it is possible to determine that the block heater H is operating in the case in which the block heater H is operating, and determine that the block heater H is not operating in the case in which the block heater H is not operating.

Note that in this case, in the case of judging Yes in the judgment process of step S9 or in the case of judging No in the judgment process of step S10, it is unclear whether the block heater H is operating or not operating.

If the case of judging Yes in the judgment process of step S9 is considered, as described earlier, in this case, there is a possibility that the electric pump 6 is working normally, but because some kind of abnormality such as an obstruction in the circuit 5 is occurring, the change ΔT in the temperature T of the refrigerant 3 that has briefly increased to the first threshold ΔT1 or greater (step S6: Yes) is no longer falling.

For this reason, in such a case, since it is conceivable to prioritize action dealing with the abnormality rather than continuing with the determination of whether the block heater H is operating, for instance, the process may be configured to switch automatically to a different process, such as a process of checking for the occurrence of an abnormality, inspecting the cause, or the like, or a process of dealing with the abnormality, or alternatively, to execute a process such as warning the user with a display, sound, or the like of the possibility that an abnormality is occurring.

Also, if the case of judging No in the judgment process of step S10 is considered, a pulse in the temperature T of the refrigerant 3 has occurred in which the change ΔT in the temperature T of the refrigerant 3 briefly increases to the first threshold ΔT1 or greater (step S6: Yes) and then falls to less than the second threshold ΔT2 (step S7: Yes), but during this period, the change ΔT in the temperature T does not become equal to or greater than the third threshold ΔT3 set to a larger value than the first threshold ΔT1 and the like (step S10: No).

In this case, as described earlier, the third threshold ΔT3 is set to a value that the change ΔT in the temperature T of the refrigerant 3 would reach plausibly in the case in which the block heater H is being used in a normal usage state and is operating, but would not reach plausibly in other cases. For this reason, a variety of causes are conceivable for the above result (a No determination in step S10), such as that the above pulse in the temperature T of the refrigerant 3 is caused by something other than the operation of the block heater H, or alternatively, the pulse in the temperature T of the refrigerant 3 is caused by the operation of block heater H, but the usage state of the block heater H is not the normal usage state (the block heater H is not attached to the engine 2 appropriately, the block heater H is operating but the amount of generated heat is less than normal, there is too little power supplied to the block heater H, or the like).

However, in any case, if it is unclear whether the block heater H is operating in this way but the block heater H is determined to be operating because there is a pulse in the temperature T of the refrigerant 3, there is a risk of returning a false determination result when the block heater H is not actually operating. For this reason, in such cases, it is desirable to configure the process not to determine that the block heater H is operating or not operating (in other words, an indeterminate result).

Effects

As above, according to the external heater operation determination system 1 of this example, the refrigerant temperature sensor 7 is disposed such that if the refrigerant 3 is not circulating through the circuit 5, the temperature T of the refrigerant 3 detected by the refrigerant temperature sensor 7 in the circuit 5 does not rise even if the block heater H is operating, whereas if the refrigerant 3 is circulating through the circuit 5, the temperature T of the refrigerant 3 detected by the refrigerant temperature sensor 7 changes. Additionally, on the basis of the post-circulation change ΔT in the temperature T when the temperature T of the refrigerant 3 detected by the refrigerant temperature sensor 7 changes in association with the circulation of the refrigerant 3 through the circuit 5, the determination device 8 determines that the block heater H is operating (see Exemplary Configuration 1 above), that the block heater H is not operating (see Exemplary Configuration 2 above), or both (see Exemplary Configuration 3 above).

For this reason, for instance, even if the vehicle 10 is a vehicle in which the engine 2 is not started and the circulation of cooling water for the engine 2 is not started at the point in time when the vehicle 10 enters the Ready-ON state, such as a hybrid electric vehicle (HEV) or a plug-in hybrid electric vehicle (PHEV), if the vehicle 10 enters the Ready-ON state, the circulation of the refrigerant 3 in the PCU 4 is started. For this reason, in the external heater operation determination system 1 according to this example, the above determination process may be executed at the point in time when the vehicle 10 enters the Ready-ON state.

Additionally, in the external heater operation determination system 1 according to this example, as described above, if the block heater H is operating, the refrigerant 3 heated locally inside the circuit 5 nearby (near a first device) begins to circulate, and by detecting the change ΔT in the temperature T when this refrigerant 3 first passes through the site of the refrigerant temperature sensor 7, it is determined that the block heater H is operating or not operating (or both). Additionally, this determination may be executed in several seconds to a dozen or so seconds (or several dozen seconds) from when the refrigerant 3 starts to circulate (that is, from Ready-ON). For this reason, according to the external heater operation determination system 1 of this example, it becomes possible to execute the determination process in a short time from when the refrigerant 3 starts to circulate.

Also, in the hypothetical case of using the cooling water of the engine 2 as the refrigerant, if the cooling water of the engine 2 is heated by the block heater H, the cooling water will be heated overall throughout the circuit, making it difficult to obtain a difference in the temperature distribution of the cooling water at each portion of the circuit, and even if the change ΔT in the temperature T of the refrigerant 3 is monitored as in this example, there will be no change in the temperature of the cooling water that has started to circulate, or even if a there is change, the difference will be slight, making it difficult to appropriately determine whether the block heater H is operating.

However, if the refrigerant 3 for cooling the PCU 4 is used as the refrigerant like in the external heater operation determination system 1 according to this example, although the temperature of the refrigerant 3 in the circuit 5 inside the engine room 15 rises due to the heat of the operating block heater H, the temperature T of the refrigerant 3 in the portion of the circuit 5 inside the PCU 4 does not rise. For this reason, since a temperature distribution occurs in the refrigerant 3 inside the circuit 5, when the refrigerant 3 starts to circulate, a change in the temperature T of the refrigerant 3 effectively occurs. For this reason, on the basis of the effectively detected change ΔT in the temperature T of the refrigerant 3, it becomes possible to appropriately determine that the block heater H is operating, that the block heater H is not operating, or both.

Note that the predetermined elapsed times Δτ1, Δτ2, and Δτ3 described above are decided according to the length and shape of the circuit 5 from the engine room 15 to the PCU 4, the circulation speed of the refrigerant 3 inside the circuit 5, and the like. For this reason, the predetermined elapsed time Δτ1 and the like basically are predetermined for each vehicle model having the same structure and the like of the engine 2 and the circuit 5. Additionally, it is also possible to change the above first threshold ΔT1 to the third threshold ΔT3 and the like depending on the ambient temperature (that is, as a function of the ambient temperature).

[Extensions to the Applicability and the Like of the Present Invention]

Hereinafter, extensions to the applicability and the like of an example of the present invention will be described. The description of the above example presupposes that the vehicle 10 is a plug-in hybrid electric vehicle, but the vehicle 10 is not limited to this case, and insofar as the circuit 5 has a configuration like the above, the vehicle 10 may also be a hybrid electric vehicle, an electric vehicle, a fuel cell vehicle, or the like, and the vehicle 10 may also be a gasoline vehicle insofar as the vehicle includes the circuit 5 like the above.

Also, the above example describes a case in which the external heater is the block heater H, but the external heater may also be a heater of a type other than a block heater insofar as the external heater is attached to any device (first device) inside the vehicle 10 and heats the device, is not attached to the device during the manufacturing stage of the vehicle 10 (that is, the heater is optional (external)), and whose starting and stopping is obviously not controllable but also not detectable by each electronic control unit and the like inside the vehicle 10.

Furthermore, the above example describes a case in which the first device to which the external heater is attached is the engine 2, but the first device may be any device that is preheated (or expected to be preheated) while the vehicle 10 is in a soak state, and for which the temperature of a portion of the refrigerant 3 in the circuit 5 of the refrigerant 3 for cooling the first device rises due to the heat generated by the operation of the external heater attached to the first device. For instance, the first device may be a battery, a motor (the motor of a vehicle such as a hybrid electric vehicle, a plug-in hybrid electric vehicle, an electric vehicle, or a fuel cell vehicle), or the like. Also, the first device (for instance, the engine 2) is not required to be disposed in the front of the vehicle 10 like in the above example, and may also be disposed in the rear of the vehicle 10 or the like.

Also, the above example describes a case in which the first device is a separate device and the second device to be cooled by the refrigerant 3 is a power control unit (PCU 4), but it is sufficient for the second device to satisfy conditions like the above and for the circuit 5 of the refrigerant 3 to have the above configuration, and the second device may also be a water-cooled battery or a rear inverter, rear motor, or the like of an electric four-wheel drive vehicle positioned away from the first device (for instance, the engine 2). Note that in the case in which the refrigerant 3 for cooling these devices does not circulate at the Ready-ON time (or there is a possibility of not circulating), it is sufficient to cause the refrigerant 3 to circulate for the several seconds to a dozen or so seconds (or several dozen seconds) while the determination device 8 performs the determination process.

Also, the above example describes a case of using the refrigerant temperature sensor 7 closest to the refrigerant inlet 41 (see FIG. 2) of the PCU 4 from among the refrigerant temperature sensors provided inside the PCU 4 as the temperature detection device that detects the temperature T of the refrigerant 3, but another refrigerant temperature sensor from among the refrigerant temperature sensors provided inside the PCU 4 may also be used, and in addition, the refrigerant temperature sensor 7 may also be provided in a portion of the circuit 5 outside the PCU 4. Note that in this case, if the refrigerant temperature sensor 7 is disposed near a device that generates heat, such as the engine 2 or the block heater H, since the refrigerant temperature sensor 7 will be influenced by such heat, it is desirable to provide the refrigerant temperature sensor 7 at a position that is not directly influenced by the heat of heat-generating elements such as the engine 2 and the block heater H.

[Application of Determination Result by External Heater Operation Determination System 1 to Another System]

Meanwhile, in Exemplary Configuration 1 (see FIG. 5 and the like) and Exemplary Configuration 3 (see FIG. 8 and the like) according to the above example, as described above, in the case in which the block heater H attached to the engine 2 is operating, the determination device 8 is able to detect this state and appropriately determine that the block heater H is operating.

Additionally, since the block heater H operating means that the block heater H is coupled to an external power outlet, a serious problem may occur if the vehicle 10 put in the Ready-ON state starts moving in this state. For this reason, for instance, in the case in which the determination device 8 determines that the block heater H is operating in this way, it is possible to execute a control that suppresses the movement of the vehicle 10 such that the vehicle 10 does not start moving even if the driver steps on the accelerator pedal.

In this case, although omitted from illustration, for instance, in the case of determining that the block heater H is operating, the determination device 8 transmits a signal or the like expressing this state (that is, the determination result) to an electronic control system that controls the action of the engine and motor of the vehicle 10 or the like. Additionally, in the case in which the signal or the like has been received, even if an accelerator pedal position detector that detects the accelerator pedal position transmits an accelerator pedal position signal indicating that the accelerator pedal has been depressed, the electronic control system may be configured not to control the engine, motor, and the like in response, but instead execute control to keep the vehicle 10 stopped (that is, movement suppression control). Note that in this case, for instance, a process such as Warning the driver that the block heater H is still coupled to the external power outlet is executed.

In this way, in the case in which the determination device 8 of the external heater operation determination system 1 determines that the block heater H is operating, it is possible to use the information in a movement suppression control of the vehicle 10, for instance.

[Application to Determination of Malfunction in Multiple Temperature Sensors Attached to Engine or Nearby]

Also, in the case in which the block heater H is attached to the engine 2 like in the above example, if the block heater H is operating, the heat generated thereby may influence a determination of malfunction in multiple temperature sensors attached to the engine 2 or nearby in some cases. Note that the temperature sensors in this case are used to control the engine 2 and the like, and are different from the refrigerant temperature sensor 7 that detects the temperature T of the refrigerant 3 for cooling the second device described above.

Figure 9:
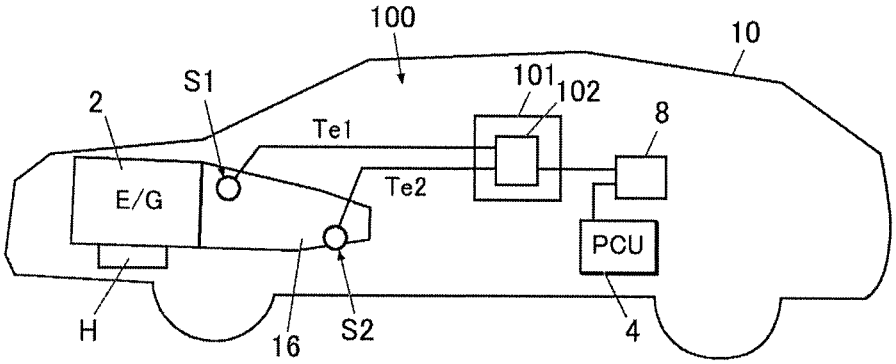
FIG. 9 is a diagram illustrating a configuration of a vehicle control system including an external heater operation determination system.

In other words, as illustrated in FIG. 9 for instance, a vehicle control system 100 that controls the engine 2, a transmission 16, and the like installed on-board the vehicle 10 is provided with at least an electronic control system 101 and a temperature sensor malfunction determination device 102 integrated into the electronic control system 101 (or provided discretely from the electronic control system 101). Additionally, data about temperatures Te1 and Te2 output from multiple temperature sensors S1 and S2 attached to the engine 2 or nearby is input into each of the electronic control system 101 and the temperature sensor malfunction determination device 102.

Also, an external heater, namely the block heater H, is attached to the engine 2. Additionally, the temperature sensor malfunction determination device 102 is configured to determine whether a malfunction is occurring in the multiple temperature sensors S1 and S2 attached near the engine 2. Note that there may also be three or more temperature sensors. Also, FIG. 9 illustrates an example in which the temperature sensors S1 and S2 are attached to the transmission 16 directly coupled to the engine 2, but the configuration is not limited thereto.

Figure 10:
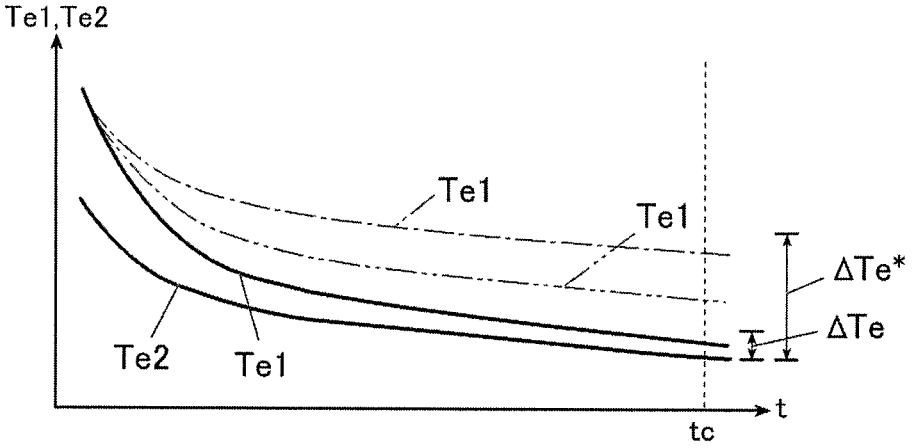

In this case, if the block heater H is not operating, after the vehicle 10 stops, since the temperature of the engine 2 and the like proceeds to drop while in the soak state, hypothetically, if the temperature sensors S1 and S2 are activated while in the soak state, as illustrated in FIG. 10, the temperatures Te1 and Te2 detected by the temperature sensors S1 and S2 gradually decrease in accordance with the temperature drop of the engine 2 and the like.

Additionally, if the soak time becomes sufficiently long, such as six hours or longer, for instance, since the temperature of the engine 2 and the like falls to approximately the ambient temperature, if the temperature sensors S1 and S2 are normal, the temperatures Te1 and Te2 detected by the temperature sensors S1 and S2 at this point in time (that is, a point in time at which a sufficient soak time has elapsed; see tc in FIG. 10) also become approximately the ambient temperature, and are expected to become nearly the same temperature. Conversely, if there is a significant difference between the temperatures Te1 and Te2 detected by the temperature sensors S1 and S2 at this point in time, it is conceivable that a malfunction is occurring in one (or both) of the temperature sensors S1 and S2.

In this exemplary configuration, the temperature sensor malfunction determination device 102 of the vehicle control system 100 utilizes the above to determine whether a malfunction is occurring in any of the temperature sensors S1 and S2. Specifically, the temperature sensor malfunction determination device 102 has a determination threshold ΔTe, causes the temperature sensors S1 and S2 to detect the temperatures Te1 and Te2 when the soak time is a predetermined time or longer, and in the case in which the absolute value |Te1−Te2| of the difference between the temperatures Te1 and Te2 respectively output from the temperature sensors S1 and S2 exceeds the determination threshold ΔTe, the temperature sensor malfunction determination device 102 determines that a malfunction is occurring in either one of the temperature sensors S1 and S2.

Additionally, as described above, in the case in which the block heater H is not operating, since the temperatures Te1 and Te2 output from the normal (that is, non-malfunctioning) temperature sensors S1 and S2 become nearly the same temperature after a sufficient soak time elapses, the absolute value |Te1−Te2| of the difference between the two becomes nearly 0. Also, if a malfunction is occurring, the absolute value |Te1−Te2| of the difference between the two becomes a value significantly different from 0. For this reason, the above determination threshold ΔTe may be set to a small value close to 0.

However, if the block heater H is operating, since the portion where the temperature sensor S1 is attached to a position close to the engine 2 is heated by the heat of the block heater H, as illustrated by the one-dot chain line in FIG. 10, the temperature Te1 output from the temperature sensor S1 does not fall to the ambient temperature even if a sufficient soak time elapses. On the other hand, the temperature Te2 output by the temperature sensor S2 attached to a position farther away from the engine 2 falls to a temperature close to the ambient temperature when a sufficient soak time elapses.

In this way, in the case in which the block heater H is operating, even if both of the temperature sensors S1 and S2 are working normally, the absolute value |Te1−Te2| of the difference between the temperatures Te1 and Te2 output from the temperature sensors S1 and S2 does not become nearly 0, and a value with some degree of magnitude occurs. For this reason, as illustrated in FIG. 10, in the case in which the block heater H is operating, a determination threshold ΔTe* must be made larger than the determination threshold ΔTe for the case in which the block heater H is not operating.

In the case in which the vehicle 10 is not provided with the external heater operation determination system 1 according to the above example, since the temperature sensor malfunction determination device 102 is unable to ascertain whether the block heater H is attached to the engine 2 and also whether the block heater H is operating, the above determination threshold ΔTe cannot be used as the determination threshold when executing the malfunction determination with respect to the temperature sensors S1 and S2, and only the determination threshold ΔTe* can be used. This is because, as the graph in FIG. 10 demonstrates, if the small determination threshold ΔTe is used when the block heater H is operating, hypothetically, even if the temperature sensors S1 and S2 are both working normally, since the absolute value |Te1−Te2| of the difference exceeds the determination threshold ΔTe, a false determination that either one of the temperature sensors S1 and S2 is malfunctioning will be made.

However, if only the large determination threshold ΔTe* can be used as the determination threshold, for instance, in a situation in which a malfunction is occurring in the temperature sensor S1 and the block heater H is not operating, as illustrated by the two-dot chain line in FIG. 10, even in the case in which the temperature Te1 output from the temperature sensor S1 does not fall to approximately the ambient temperature after a sufficient soak time elapses, since the temperature sensor malfunction determination device 102 will not determine that either one of the temperature sensors S and S2 is malfunctioning unless the absolute value |Te1−Te2| of the difference exceeds the determination threshold ΔTe*, the malfunction occurring in the temperature sensor S1 can no longer be detected.

For this reason, the large determination threshold ΔTe* must be used in the case in which the block heater H is operating, but at least in the case in which the block heater H is not operating, it is desirable to use the small determination threshold ΔTe to determine whether a malfunction is occurring in the temperature sensors S1 and S2 precisely (that is, without overlooking the occurrence of a phenomenon like the two-dot chain line in FIG. 10 (in this case, a malfunction of the temperature sensor S1)).

On the other hand, as described in the above example, if the external heater operation determination system 1 is configured like Exemplary Configuration 2 (see FIG. 7 and the like) or Exemplary Configuration 3 (see FIG. 8 and the like) described above, in the case in which the block heater H is not operating, the determination device 8 of the external heater operation determination system 1 is able to appropriately determine that the block heater H is not operating.

For this reason, for instance, the determination device 8 of the external heater operation determination system 1 may be configured to transmit a determination result (such as a result determining that the block heater H is operating or a result determining that the block heater H is not operating) to the temperature sensor malfunction determination device 102 of the vehicle control system 100, and in the case in which the determination device 8 has determined that the block heater H is not operating, the temperature sensor malfunction determination device 102 may determine whether a malfunction is occurring in the temperature sensors S1 and S2 by using the small determination threshold ΔTe rather than the large determination threshold ΔTe* used in the case in which the block heater H is operating.

Additionally, according to this configuration, at least in the case in which the block heater H is not operating, the temperature sensor malfunction determination device 102 becomes able to use the small determination threshold ΔTe to determine whether a malfunction is occurring in the temperature sensors S1 and S2, and in the case in which a malfunction is occurring in either one of the temperature sensors S1 and S2, the temperature sensor malfunction determination device 102 becomes able to determine and detect the malfunction appropriately and sensitively.

Additionally, as above, according to the external heater operation determination system 1 according to this example, it is possible to determine whether the block heater H is not operating in a short time from when the refrigerant 3 starts to circulate (that is, from Ready-ON). For this reason, the determination in the vehicle control system 100 above that uses the above determination result to determine whether a malfunction is occurring in the temperature sensors S1 and S2 may also be executed in a short time from Ready-ON.

Note that in the case in which the determination device 8 of the external heater operation determination system 1 is configured like in Exemplary Configuration 3, if a Yes determination is made in step S9 or a No determination is made in step S10 of the flowchart in FIG. 8, for instance, whether the block heater H is operating or not operating becomes indeterminate. Additionally, in such a case, there is a possibility that a temperature difference actually is occurring at each position where the temperature sensors S1 and S2 are attached, and even if the temperature sensors S1 and S2 are both normal, there is a possibility of a significant difference between the temperatures Te1 and Te2 detected by the temperature sensors S1 and S2. For this reason, in the case in which whether the block heater H is operating or not operating is indeterminate as above, the malfunction determination is made using the large determination threshold ΔTe*.

Note that the present invention is not limited to the above example and the like, and obviously may be modified suitably without departing from the gist of the present invention.

According to the example of the present invention, it is possible to appropriately determine that an external heater attached to an engine or the like is operating or not operating.

Although the preferred examples of the present invention have been described in detail with reference to the appended drawings, the present invention is not limited thereto. It is obvious to those skilled in the art that various modifications or variations are possible insofar as they are within the technical scope of the appended claims or the equivalents thereof. It should be understood that such modifications or variations are also within the technical scope of the present invention.

The invention claimed is:

1. An external heater operation determination system comprising, in a vehicle:

a first device to be heated by an attached external heater;

a second device, separate from the first device, to be a target of cooling by a refrigerant;

a circulation device configured to circulate the refrigerant through a circuit, wherein the refrigerant that circulates through the circuit cools the second device and does not cool the first device; and a temperature detection device configured to detect a temperature of the refrigerant wherein the temperature detection device is disposed such that if the refrigerant is not circulating through the circuit, the temperature of the refrigerant detected by the temperature detection device in the circuit does not rise even if the external heater is operating, whereas if the refrigerant is circulating through the circuit, the temperature of the refrigerant detected by the temperature detection device changes, and the external heater operation determination system comprises a determination device able to determine that the external heater is not operating on a basis of a change in the temperature after the circulation of the refrigerant.

2. The external heater operation determination system according to claim 1, wherein the determination device determines that the external heater is not operating in a case in which the change in the temperature of the refrigerant does not become equal to or greater than a predetermined value during a period from an activation of the circulation device until a predetermined period elapses.

3. The external heater operation determination system according to claim 2, wherein the predetermined value is set to a larger value than a maximum change by which the temperature of the refrigerant may rise during the predetermined period in a state in which the external heater is not made to operate.

4. The external heater operation determination system according to claim 2, wherein a predetermined first period is set to a longer amount of time than a maximum amount of time from when the circulation device is activated and the refrigerant inside the circuit starts to circulate until the refrigerant whose temperature has risen because of a heat of the external heater reaches the temperature detection device in a case in which the external heater is operating.

5. The external heater operation determination system according to claim 1, wherein the determination device executes a determination process in a case in which a state of both the second device and the circulation device being stopped has continued for a predetermined amount of time or longer until a Ready-ON operation is performed by a user.

6. The external heater operation determination system according to claim 1, wherein the temperature detection device is disposed at a position not directly influenced by a heat of the external heater.

7. The external heater operation determination system according to claim 1, wherein the temperature detection device is a temperature detection device disposed inside the second device.

8. A vehicle control system comprising:

the external heater operation determination system according to claim 1; and a temperature sensor malfunction determination device configured to determine whether a malfunction is occurring in a plurality of temperature sensors attached near an engine acting as the first device, wherein the temperature sensor malfunction determination device determines that a malfunction is occurring in any of the plurality of temperature sensors in a case in which a difference between temperatures output from the plurality of temperature sensors exceeds a determination value, and in a case in which the determination device of the external heater operation determination system has determined that the external heater is not operating, the temperature sensor malfunction determination device makes the determination using the determination value that is a smaller value than the determination value used otherwise.

9. An external heater operation determination system comprising, in a vehicle:

a first device to be heated by an attached external heater;

a second device, separate from the first device, to be a target of cooling by a refrigerant;

a circulation device configured to circulate the refrigerant through a circuit, wherein the refrigerant that circulates through the circuit cools the second device and does not cool the first device; and a temperature detection device configured to detect a temperature of the refrigerant, wherein the temperature detection device is disposed such that if the refrigerant is not circulating through the circuit, the temperature of the refrigerant detected by the temperature detection device in the circuit does not rise even if the external heater is operating, whereas if the refrigerant is circulating through the circuit, the temperature of the refrigerant detected by the temperature detection device changes, and the external heater operation determination system comprises a determination device able to determine that the external heater is operating on a basis of a change in the temperature after the circulation of the refrigerant.

10. The external heater operation determination system according to claim 9, wherein the determination device determines that the external heater is operating in a case in which, after the circulation device is activated, the change in the temperature of the refrigerant rises to become a first value or greater, and afterward falls to less than a second value.

11. The external heater operation determination system according to claim 10, wherein the determination device determines that the external heater is operating in a case in which, after the circulation device is activated, the change in the temperature of the refrigerant rises to become the first value or greater, and afterward falls to less than the second value, while in addition, the change becomes equal to or greater than a third value set to a larger value than the first value within a period after the change becomes the first value or greater until the change falls to less than the second value.

12. The external heater operation determination system according to claim 10, wherein the first value is preset to a larger value than a maximum change by which the temperature of the refrigerant may rise during a predetermined first period in a state in which the external heater is not made to operate.

13. The external heater operation determination system according to claim 10, wherein a third value is set to a value that the change in the temperature of the refrigerant may reach during a predetermined second period in a case in which the external heater is operating, but does not reach within the predetermined second period otherwise.

14. The external heater operation determination system according to claim 9, wherein the determination device executes a determination process in a case in which a state of both the second device and the circulation device being stopped has continued for a predetermined amount of time or longer until a Ready-ON operation is performed by a user.

15. The external heater operation determination system according to claim 9, wherein the temperature detection device is disposed at a position not directly influenced by a heat of the external heater.

16. The external heater operation determination system according to claim 9, wherein the temperature detection device is a temperature detection device disposed inside the second device.

17. A vehicle control system comprising:

the external heater operation determination system according to claim 9; and a temperature sensor malfunction determination device configured to determine whether a malfunction is occurring in a plurality of temperature sensors attached near an engine acting as the first device, wherein the temperature sensor malfunction determination device determines that a malfunction is occurring in any of the plurality of temperature sensors in a case in which a difference between temperatures output from the plurality of temperature sensors exceeds a determination value, and in a case in which the determination device of the external heater operation determination system has determined that the external heater is not operating, the temperature sensor malfunction determination device makes the determination using the determination value that is a smaller value than the determination value used otherwise.

* * * * *